US005311744A

United States Patent [19]

Sweeney et al.

[11] Patent Number: 5,311,744

[45] Date of Patent: May 17, 1994

[54] CRYOGENIC AIR SEPARATION PROCESS AND APPARATUS

[75] Inventors: Paul A. Sweeney, Basking Ridge; Ramachandran Krishnamurthy, Piscataway, both of N.J.

[73] Assignee: The BOC Group, Inc., New Providence, N.J.

[21] Appl. No.: 991,663

[22] Filed: Dec. 16, 1992

[51] Int. Cl.[5] ..... F25J 3/04

[52] U.S. Cl. ..... 62/22; 62/24; 62/31; 62/37; 62/38; 62/41

[58] Field of Search ..... 62/22, 24, 41, 31, 37, 62/38

[56] References Cited

U.S. PATENT DOCUMENTS

| | | | |
|---|---|---|---|
| 4,756,731 | 6/1988 | Erickson | 62/22 |
| 4,842,625 | 6/1989 | Allam et al. | 62/22 |
| 4,854,954 | 8/1989 | Erickson | 62/22 |
| 4,883,516 | 11/1989 | Layland et al. | 62/22 |
| 5,019,145 | 5/1991 | Rohde et al. | 62/22 |
| 5,034,043 | 7/1991 | Rottmann | 62/22 |
| 5,076,823 | 12/1991 | Hansel et al. | 62/22 |
| 5,077,978 | 1/1992 | Agrawal et al. | 62/22 |
| 5,078,766 | 1/1992 | Guilleminot | 62/22 |
| 5,133,790 | 7/1992 | Bianchi et al. | 62/22 |
| 5,161,380 | 11/1992 | Cheung | 62/22 |
| 5,197,296 | 3/1993 | Prosser | 62/22 X |

*Primary Examiner*—Henry Bennett
*Assistant Examiner*—Christopher B . Kilner
*Attorney, Agent, or Firm*—David M. Rosenblum; Larry R. Cassett

[57] ABSTRACT

A cryogenic air separation process and method in which air is cooled and after compression and purification then rectified in a rectification column to produce an oxygen rich liquid. An argon-oxygen stream containing liquid lean in nitrogen is separated to form oxygen and argon streams. Argon vapor is condensed to supply reflux to the argon column. An oxygen rich liquid stream is expanded to a pressure at which the oxygen rich liquid is at or below the condensation temperature of the argon vapor and is then vaporized against condensing the argon vapor. The vaporized oxygen rich liquid is then introduced into a nitrogen stripper column and nitrogen is stripped therefrom by a stripper gas to produce the argon-oxygen liquid which is introduced into the argon column. The nitrogen stripper column is regulated to operate at a predetermined pressure range so that the entry level at which oxygen enters the nitrogen stripper column has a pressure level no greater than the pressure of the oxygen rich liquid after expansion. Argon is removed from the top of the argon column as a product. The process and apparatus can be operated to produce high purity argon vapor or liquid very lean in nitrogen and oxygen with the use of trays and/or structured packing as liquid contacting mass transfer elements in the columns. Additionally, high purity oxygen and nitrogen products can also be produced by such process and apparatus.

9 Claims, 1 Drawing Sheet

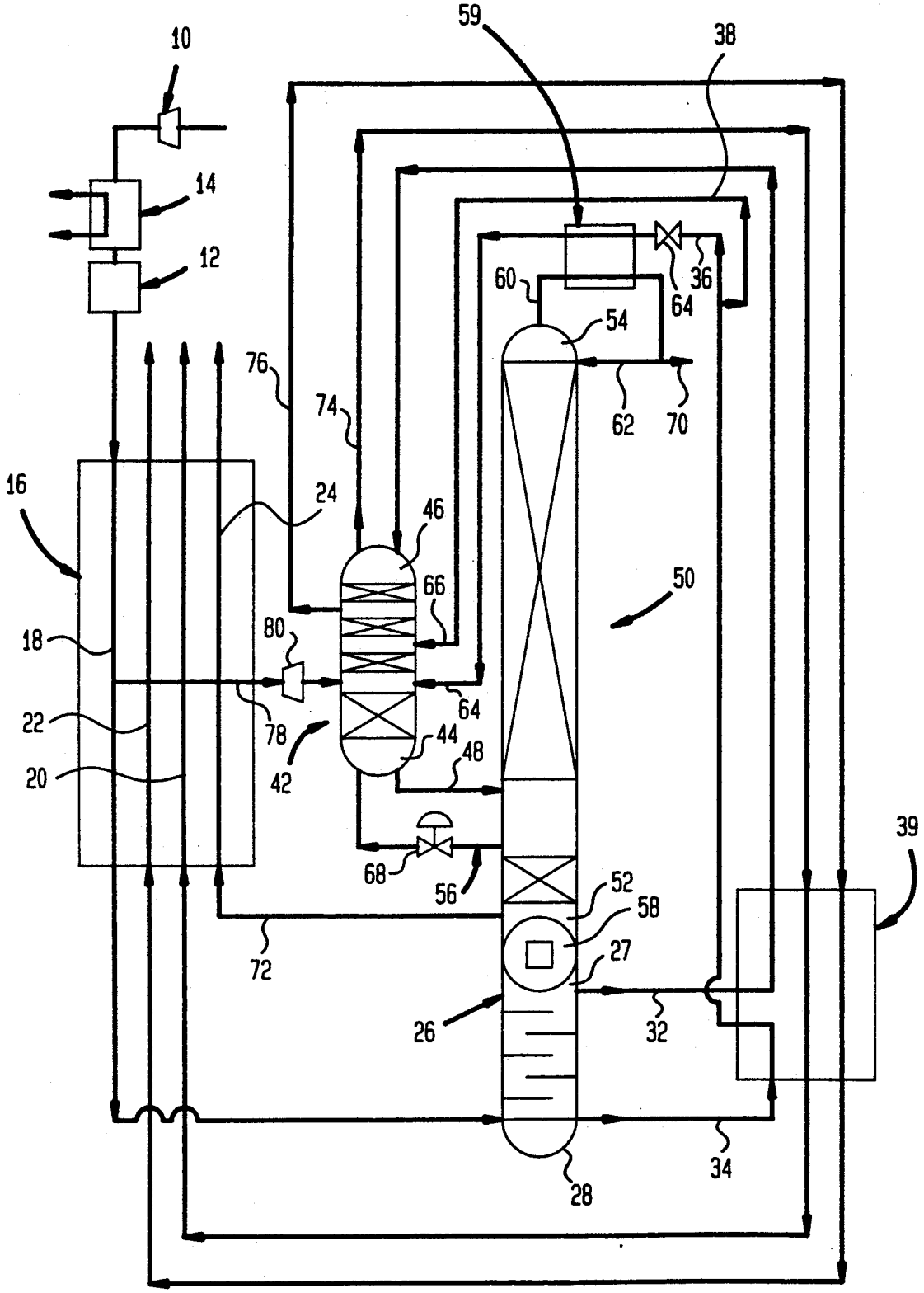
10
14
12
59
38
36
64
60
54
62
70
76
74
16
24
46
66
50
18
80
22
78
64
44
48
42
20
39
68
56
52
58
27
72
26
32
34
28

CRYOGENIC AIR SEPARATION PROCESS AND APPARATUS

BACKGROUND OF THE INVENTION

The present invention relates to a process and apparatus for cryogenically separating air to produce high purity argon. More particularly, the present invention relates to such a process and apparatus employing a three column distillation system in which argon is produced in an argon column having a sufficient number of theoretical stages to produce the high purity argon as a product.

Conventionally, argon is separated from air in a three column distillation system which consists of a high pressure column, a low pressure column and an argon column. In such a system, the high pressure column produces an oxygen rich liquid, the low pressure column further refines the oxygen rich liquid to produce an argon enriched mixture as a vapor, and the argon column refines the argon enriched mixture to produce crude argon as a tower overhead. In order to provide reflux for the argon column, a stream of the crude argon is condensed in a head condenser by a subcooled and expanded stream of the oxygen rich liquid from the high pressure column.

The crude argon contains oxygen and nitrogen which must be removed to produce high purity argon. Therefore, the crude argon is upgraded, generally through catalytic combustion to remove the oxygen followed by adsorbers to remove formed water and further distillation to remove nitrogen.

Theoretically, it is possible to increase the number of stages of separation within the argon column to enhance the separation of argon and oxygen. However, at least with argon columns employing trays or plates, this is not practical because the resultant pressure drop would lower the condensation temperature of the crude argon and therefore raise the degree of expansion required of the oxygen enriched liquid such that the oxygen enriched liquid would be at too low a pressure to flow into the low pressure column. The operating pressure range of the low pressure column cannot not be reduced to accommodate such a highly expanded oxygen enriched liquid because the crude argon feed flows from the low pressure column to the argon column under impetus of the pressure of the low pressure column.

There are prior art three column plants that are designed with a sufficient number of theoretical stages in the argon column to separate oxygen from the argon to an extent that catalytic combustion is not required in the upgrading of the crude argon. An example of this can be found in U.S. Pat. No. 5,019,145 in which 150 theoretical stages are employed in an argon rectification column utilizing low pressure drop packings. The use of such packings prevents the excessive pressure drop that would otherwise occur with plates or trays.

U.S. Pat. No. 5,133,790 is an example of cryogenic rectification process and apparatus in which both oxygen and nitrogen concentrations are directly reduced so that a high purity argon product can be withdrawn directly from the argon column without subsequent catalytic and distillation stages. In this patent, the low pressure column is operated with a sufficient number of theoretical stages (provided by structured packing) such that the nitrogen concentration in the feed to the argon column is less than 50 parts per million. Since less nitrogen is being fed to the argon column, there will be a lower concentration of nitrogen in the argon produced in the argon column. In order to remove the oxygen, the argon column can be fabricated with structured packing to provide approximately 150 theoretical stages, as called for in U.S. Pat. No. 5,019,145, to effect the degree of oxygen separation required for the production of the high purity argon product.

The prior art patents, discussed above, both depend on the use of a low pressure drop packing in at least the argon column to prevent excessive pressure drop. As will be discussed, the present invention provides a process and apparatus for producing a high purity argon product directly from the argon column that does not depend on structured packing for its operability. In fact, both the argon and low pressure columns can be conventionally designed with sieve trays, a low pressure drop packing or any other type of liquid-gas contact device or any combination thereof. Further advantages of the present invention will become apparent from the following discussion.

SUMMARY OF THE INVENTION

In accordance with the present invention, a cryogenic air separation process is provided to produce high purity argon. In the process, air is compressed and purified. After the compression and purification thereof, the air is rectified in a rectification column so that an oxygen rich liquid column bottom and a nitrogen rich tower overhead are produced within the rectification column. An argon-oxygen containing liquid lean in nitrogen is separated within an argon column into a liquid oxygen column bottom and a high purity argon vapor tower overhead. An argon stream composed of the high purity argon vapor tower overhead is removed from the argon column. The argon stream is then condensed by indirect heat exchange and after having been condensed, is introduced back into the argon column as reflux.

An oxygen enriched stream composed of the oxygen enriched liquid column bottom is removed from the rectification column and is expanded to a pressure at which the oxygen enriched stream has a reduced temperature no greater than the condensation temperature of the high purity argon tower overhead. The oxygen enriched stream is then at least partially vaporized against the condensation of the argon vapor stream through the indirect heat exchange. Thereafter, the oxygen enriched stream is introduced into the nitrogen stripper column, after having been at least partially vaporized, at an entry level thereof having a concentration compatible with that of the oxygen enriched stream. Nitrogen is stripped from the oxygen enriched stream introduced into the nitrogen stripper column with a stripper gas so that the argon-oxygen containing liquid lean in nitrogen is produced as an argon-oxygen liquid column bottom. An argon-oxygen stream composed of the argon-oxygen liquid column bottom is removed from the nitrogen stripper column and is then introduced into the argon column for the separation of the argon-oxygen containing liquid.

The nitrogen stripper column is regulated to operate at a predetermined pressure range so that the entry level of the oxygen enriched stream is at a pressure level no greater than the pressure of the oxygen enriched stream after expansion. A product stream composed of the high purity argon vapor tower overhead is removed from the argon column.

In a further aspect, the present invention provides an air separation apparatus for producing high purity argon. In such apparatus a compression means is provided for compressing the air and a purification means connected to the compression means is provided for purifying the air. A cooling means is connected to the purification means for cooling the air to a temperature suitable for its rectification.

A distillation column system is provided having a rectification column, an argon column, and a nitrogen stripper column. The rectification column is connected to the cooling means and is configured to rectify the air into an oxygen rich column bottom and a nitrogen rich vapor tower overhead. The argon column is configured to separate an argon-oxygen containing liquid lean in nitrogen into a liquid oxygen column bottom and a high purity argon vapor tower overhead. An expansion valve is connected to the rectification column and is configured to expand an oxygen enriched stream composed of the oxygen rich column bottom to a pressure at which the oxygen enriched stream has a reduced temperature no greater than the condensation temperature of the high purity argon vapor tower overhead. A head condenser is connected to the argon column and the expansion valve. The head condenser is configured to condense an argon stream composed of the high purity argon vapor tower overhead against at least partially vaporizing the oxygen enriched stream and to return the condensed argon vapor stream after having been condensed to the argon column as reflux. The nitrogen stripper column is configured to strip nitrogen from the oxygen rich liquid with a stripper gas so that the argon-oxygen containing liquid lean in nitrogen as a column bottom is formed therewithin.

The nitrogen stripper column is connected to the head condenser so that the oxygen enriched stream after having been at least partially vaporized flows into the nitrogen stripper column at an entry level thereof having a concentration compatible with the oxygen enriched stream. A means for connecting the nitrogen stripper column to the argon column is provided so that the argon-oxygen containing liquid flows into the argon column. A regulation means is connected to the nitrogen stripper column for regulating operating pressure range of the nitrogen stripper column so that the entry level of the oxygen rich liquid is at a pressure level no greater than the pressure of the oxygen enriched stream after having been expanded. A means is connected to the argon column for forming a product stream composed of the high purity argon tower overhead vapor (It can be either a liquid from the argon column head condenser or a vapor stream directly from the argon column).

As mentioned previously, the columns of the present invention can utilize packing, sieve trays, or any other liquid-gas mass transfer device, all at the option of the designer because the present invention does not depend on structured packing for its operation. Rather, the present invention utilizes a nitrogen stripper column in lieu of a low pressure column that is not coupled to the argon column in a manner contemplated in the prior art. In the prior art the argon column must be operated over a pressure range that is less than the pressure of the argon enriched draw pressure of the low pressure column. Since in the present invention the feed to the argon column is a liquid, the operating pressure range of the nitrogen stripper column can be set at or less than the pressure of the argon column feed point because in order to feed the liquid into the argon column the head of the feed can be raised either by pumping or more simply, by setting the nitrogen stripper column at a sufficient height above the entry point of the feed into the argon column. It should be noted that in order to raise the pressure of a vapor, the vapor is compressed. This is not normally done with an oxygen containing vapor such as the argon enriched vapor because of the expense of such compressors as well as the dangers inherent in their use.

Since the nitrogen stripper column can be regulated to operate over a lower pressure range than the argon column, the argon column can have a sufficient number of theoretical stages to effect an oxygen separation from the feed without the use of structured packing. Moreover, since nitrogen is being stripped from the oxygen enriched liquid in the nitrogen stripper column, the liquid feed to the argon column will be produced with very low concentrations of nitrogen. Hence, a high purity argon product can be taken directly from the argon column.

It should be pointed out that the term "column" as used herein and in the claims means a column in which an ascending vapor stream is intimately contacted in a heat and mass transfer relationship with a descending liquid stream by conventional mass transfer elements such as trays, plates or packing elements, either random or structured packings, any combination of the above, or any other type of liquid-gas mass transfer device. Furthermore, a high purity argon product as used herein and in the claims is one containing by volume, less than about 1000 ppm of oxygen and less than about 1000 ppm nitrogen. As will be discussed and shown, the present invention is capable of producing a high purity argon product having even lower oxygen and nitrogen impurity concentrations. The phrase "lean in nitrogen" as used herein and in the claims means a concentration by volume of less than about 30 ppm.

BRIEF DESCRIPTION OF THE DRAWINGS

While the specification with claims distinctly pointing out the subject matter that Applicants regard as their invention, it is believed that the invention will be better understood when taken in connection with accompanying drawings in which the sole figure is a schematic of a cryogenic air separation apparatus and process in accordance with the present invention.

DETAILED DESCRIPTION

In accordance with the accompanying figure, air is compressed by compressor 10 and is then purified by a purifier 12 to remove carbon dioxide, moisture and hydrocarbons from the air. Purification unit 12 can be formed of alumina or zeolite molecular sieve beds operating out of phase so that while one bed is in use the other bed is regenerated. An after cooler 14 is provided to remove the heat of compression. After cooler 14 can use water or a hydro-chloro-fluorocarbon as refrigerant to remove heat from the compressed and purified air stream. Thereafter, the air is cooled to a temperature suitable for rectification, conventionally, at or near its dew point, by a main heat exchanger 16 of plate and fin construction having first, second, third, and fourth passes designated by reference numerals 18, 20, 22 and 24. The air passes through pass 18 and then is introduced into the bottom of a rectification column 26. In the rectification column, a nitrogen rich vapor is produced at the top of rectification column 26 (designated by reference numeral 27) and an oxygen enriched liquid column bottom is produced in the bottom thereof (designated as reference numeral 28). The nitrogen rich vapor tower overhead after condensation is in part re-introduced into top 27 of rectification column 26 as reflux and is also formed into a stream 32.

An oxygen enriched liquid stream 34 is removed from the bottom of rectification column 26 and is then sub-cooled in a sub-cooler 39 which is of conventional construction, again, preferably of plate and fin type. Oxygen enriched liquid stream 34 is then divided into first and second partial streams 36 and 38. Turning for a moment to second partial stream 38, second partial stream 38 is then fed into a nitrogen stripper column 42 at a level thereof having a concentration compatible with that of second partial stream 38. It is to be noted that second partial stream could be expanded to a lower pressure or as illustrated, simply allowed to flash into nitrogen stripper column 42. Although not illustrated, in case of a packed column a flash separator would have to be used to introduce both gas and liquid components into the column. Within nitrogen stripper column 42, the oxygen enriched liquid is then stripped by a stripper gas (which will also be described hereinafter) to produce an argon-oxygen containing liquid lean in nitrogen at bottom 44 of nitrogen stripper column 42. A high purity nitrogen tower overhead forms at the top of nitrogen stripper column 42, designated by reference numeral 46.

The argon-oxygen liquid column bottom is then fed as a stream 48 into argon column 50. The argon-oxygen liquid thus introduced into argon column 50 is in part vaporized and is also separated so that liquid oxygen collects in the bottom of argon column 50, designated by reference numeral 52, and high purity argon collects in the top of argon column 50, designated by reference numeral 54. The vaporized argon-oxygen is then introduced into bottom 44 of nitrogen stripper column 42 as an argon-oxygen vapor stream 56 to serve as the stripper gas. The oxygen collecting in bottom 52 as column bottom, is vaporized against the condensation of nitrogen by a condenser re-boiler 58. The vaporization of the oxygen initiates the formation of an ascending vapor stream. This vapor stream becomes progressively leaner in oxygen until a high purity argon vapor tower overhead is formed at top 54 of argon column 50.

The argon vapor tower overhead is condensed and re-introduced into top 54 of argon column 50 as reflux to initiate the formation of a descending liquid stream which becomes progressively leaner in argon as it descends within argon column 50. This is done through the use of a head condenser 59, again of conventional construction, and connected to argon column 50 so that an argon vapor stream 60 is removed from argon column 50, is condensed, and returned as a condensed argon liquid stream 62 back into argon column 50 as reflux.

Such condensation occurs in head condenser 59 through indirect heat exchange with first partial stream 36 which, prior to entering head condenser 59, is expanded by an expansion valve 64 to a pressure at which the oxygen enriched liquid containing the first partial stream 36 is at a temperature at or below the condensation temperature of the argon vapor tower overhead contained with argon vapor stream 60. First partial stream 36 is vaporized within head condenser 59 against the condensation of the argon vapor and is then introduced into an appropriate level of nitrogen stripper column 42, that is, a level at which the concentration of oxygen, nitrogen and argon is compatible with the entry of first partial stream 36. It is understood that depending upon process requirements, first stream 36 could be the only oxygen enriched stream removed from rectification column 26 and further, that first stream 36 in a possible process in accordance with the present invention might only be partially vaporized.

In order for first and second partial streams 36 and 38 to flow into nitrogen stripper column 42 the levels of entry, designated by reference numerals 64 and 66, of such partial streams into nitrogen stripper column 42 must have pressures that are no greater than the pressures of first and second partial streams 36 and 38 just prior to their entry. A preferred manner of effecting such control of the operating pressure range of nitrogen stripper column 42 is to control or regulate the pressure of argon-oxygen vapor stream 56, which serves as a stripper gas, upon its entry into bottom 44 of nitrogen stripper column 42. Such pressure regulation is effected through the use of a pressure regulator valve 68 which regulates the pressure of argon-oxygen vapor stream 56 and therefore the operating pressure range of nitrogen stripper column 42.

In practice, in most possible embodiments in the present invention, nitrogen stripper column 42 will operate over a lower pressure range than argon column 50. A point worth mentioning here is that the lower pressure range of nitrogen stripper column 42 means that the highest pressure of nitrogen stripper column 42 is lower than the highest pressure found in argon column 50. A further point is that in such possible embodiments, argon column 50 will usually operate over a lower pressure range than rectification column 26, pressure ranges being compared in the same manner as those of nitrogen stripper column 42 and argon column 50. In accordance with the present invention, head is added to argon-oxygen liquid stream 48 to produce a flow into argon column 50. This is preferably accomplished by simply raising the level of nitrogen stripper column 42 so that gravity, provides the requisite head. Argon-oxygen stream 48 could be supplied with an increased head by pumping the argon-oxygen stream into argon column 50.

An argon product stream composed of the high purity argon vapor tower overhead is removed as a liquid stream 70 from head condenser 59. In this regard, the phrase "product stream composed of the high purity argon vapor" means, herein and in the claims, that the product stream could either be a liquid argon condensate or vapor directly removed from the top of argon column 50 or any combination thereof. An oxygen product stream 72, initially composed of oxygen vapor removed from argon column 50 can also be produced and sent through pass 24 of main heat exchanger 16 to help cool the incoming air. In this regard high purity oxygen can be about 99.5% purity and greater. It is understood that high purity argon products can be produced in accordance with the present invention with concommitant production of oxygen at lower purity levels. A product nitrogen stream 74 can be removed from top 46 of nitrogen stripper column 42 as well as a waste nitrogen stream 76 (removed below top 46 of nitrogen stripper column 42). Streams 74 and 76 pass through sub-cooler 39 and in indirect heat exchange with oxygen enriched liquid stream 34 and nitrogen rich stream 32 to sub-cool the same. Thereafter, streams 74 and 76 pass through passes 20 and 22 of main heat exchanger 16 and then out of the air separation apparatus as product and waste streams, respectively.

In order to maintain heat balance of the illustrated air separation process and plant design, a partially cooled subsidiary air stream 78 ("partially cooled" because such stream is withdrawn from between the cold and warm ends of main heat exchanger 16) is diverted into a turboexpander 80. The exhaust of turboexpander 80 is then introduced into an appropriate level of nitrogen stripper column 42. As can be appreciated, the exhaust could in part be introduced into nitrogen stripper column 42.

As mentioned previously, any of the columns illustrated in the figure could contain either trays or packing or combinations thereof. In the illustrated embodiment, rectification column 26 is provided with trays, nitrogen stripper column 42 and argon column 50 are provided with structured packing. Regardless of the mass transfer element employed, oxygen and argon products could be produced in the illustrated apparatus. It should be noted that in an air separation process and apparatus in accordance with the present invention, the exhaust of turboexpander 80 could be returned back into main heat exchanger 16 to provide refrigeration through the lowering of the enthalpy of the incoming air. It should also be noted that structured packing has a distinct advantage of providing a lower pressure drop than trays or plates and thus, a lower cost of operation.

The following two examples (labeled "EXAMPLE 1" and "EXAMPLE 2") are computer simulations of plant operation showing the efficacy of the use of either structured packing or sieve trays in both nitrogen stripper column 42 and argon column 50. In EXAMPLE 1, rectification column 26 utilizes 40 trays operating at an efficiency of about 100% and a pressure drop of about 0.04 psia/tray. Structured packing, for instance 700Y manufactured by Sulzer Brothers Limited of Winterthur, Switzerland are used in both nitrogen stripper column 42 and argon column 50. In EXAMPLE 2, rectification column 26 utilizes 50 trays operating at an efficiency of about 100% and a pressure drop of about 0.04 psia/tray. Trays are used in both nitrogen stripper column 42 and argon column 50. Such trays operate at an efficiency of about 70% and a pressure drop of about 0.04 psia/tray.

EXAMPLE 1: Table of Flows, Temperatures, Pressures and Composition

| | Stream | Flow kg-moles/hr | Temp. Degree K. | Pressure Bara | % $N_2$ | % Ar | % $O_2$ |
|---|---|---|---|---|---|---|---|
| 72 | before main heat exchanger 16 | 105 | 92.98 | 1.35 | 0 | 0.27 | 99.73 |
| 70 | | 4 | 89.09 | 1.23 | 0.1 ppm | 99.9992 | 8.3 ppm |
| 48 | | 241.5 | 92.4 | 1.342 | 5 ppb | 7.9 | 92.1 |
| 56 | before valve 68 | 132.5 | 92.4 | 1.342 | 5.5 ppb | 11.2 | 88.8 |
| 56 | after valve 68 | 132.5 | 92.4 | 1.335 | 5.5 ppb | 11.2 | 88.8 |
| 32 | (after subcooling) | 208.4 | 81 | 5.25 | 99.97 | 0.03 | 1 ppm |
| 74 | at top of nitrogen stripper column 42 | 260.5 | 79.5 | 1.3 | 99.985 | 0.015 | 0.3 ppm |
| 34 | (after subcooling) | 241.6 | 96 | 5.36 | 59.26 | 1.71 | 39.03 |
| 38 | | 99.5 | 96 | 5.36 | 59.26 | 1.71 | 39.03 |
| 36 | after vaporization | 142.1 | 87.03 | 1.35 | 59.26 | 1.71 | 39.03 |
| 76 | at top of nitrogen stripper column 42 | 130.5 | 79.55 | 1.303 | 99.7 | 0.3 | 19 ppm |
| 10 | prior to compression | 500 | 298 | 1 | 78.113 | 0.931 | 20.956 |
| 10 | after compression | 500 | 293 | 5.8 | 78.113 | 0.931 | 20.956 |
| 78 | after expansion | 50 | 100.84 | 1.35 | 78.113 | 0.931 | 20.956 |
| 74 | after passage through heat exchanger 38 | 260.5 | 97.51 | 1.2 | 99.985 | 0.015 | 0.3 ppm |
| 74 | after passage through main heat exchanger 16 | 260.5 | 291.37 | 1.1 | 99.985 | 0.015 | 0.3 ppm |
| 76 | after passage through heat exchanger 38 | 130.5 | 97.51 | 1.2 | 99.7 | 0.3 | 19 ppm |
| 76 | after passage through main heat exchanger 16 | 130.5 | 291.37 | 1.1 | 99.7 | 0.3 | 19 ppm |
| 72 | after passage from main heat exchanger 16 | 104.54 | 291.37 | 1.25 | 0 | 0.27 | 99.73 |

In the example given above, nitrogen stripper column 42 has approximately 60 theoretical stages. Stream 76 is withdrawn at theoretical stage 6 and passed first through heat exchanger 39 and next through main heat exchanger 16. Stream 76 can then be exhausted as waste or used to regenerate purifier 12. Stream 74 is withdrawn at theoretical stage 1 and passed first through heat exchanger 39 and next through main heat exchanger 16. Stream 74 can then be exhausted as waste or taken as product or any division of the two. Stream 34 (after subcooling) is split into streams 36 and 38. Stream 38 is flashed into nitrogen stripper column 42 at theoretical stage 26. Stream 36 is expanded through valve 64 and vaporized in argon column condenser 59. Stream 36 after vaporization is fed into nitrogen stripper column 42 at theoretical stage 30. Argon column 50 has approximately 220 stages of which 195 are rectifying and 25 are stripping. Stream 48 is taken from the bottom of nitrogen stripper 42 and fed to theoretical stage 195 of argon column 50. Stream 56 is withdrawn from argon column 50, reduced in pressure across valve 68 and fed to the bottom of nitrogen stripper 42. The argon product as indicated is produced at a rate of 4 kg-moles/hr and has a concentration of 0.1 ppm nitrogen and 8.3 ppm oxygen with balance argon.

EXAMPLE 2: Table of Flows, Temperatures, Pressures and Composition

| | Stream | Flow kg-moles/hr | Temp. Degree K. | Pressure Bara | % $N_2$ | % Ar | % $O_2$ |
|---|---|---|---|---|---|---|---|
| 72 | before main heat exchanger 16 | 105.5 | 97.6 | 2.08 | 0 | 0.5 | 99.5 |
| 70 | | 3.3 | 88.4 | 1.15 | 0.3 ppm | 99.999 | 9.3 ppm |
| 48 | | 222.15 | 94 | 1.56 | 10 ppb | 7.6 | 92.4 |
| 56 | before valve 68 | 113.35 | 96 | 1.88 | 12 ppb | 11.6 | 88.4 |
| 56 | after valve 68 | 113.35 | 94 | 1.56 | 12 ppb | 11.6 | 88.4 |
| 32 | (after subcooling) | 197.7 | 81 | 7.34 | 99.94 | 0.06 | 1 ppm |
| 74 | at top of nitrogen stripper column 42 | 261.5 | 79.5 | 1.3 | 99.97 | 0.03 | 1.3 ppm |
| 34 | (after subcooling) | 252.3 | 101 | 7.45 | 61.01 | 1.62 | 37.37 |
| 38 | | 99.5 | 101 | 7.45 | 61.01 | 1.62 | 37.37 |
| 36 | after vaporization | 142.1 | 87.35 | 1.43 | 61.01 | 1.62 | 37.37 |
| 76 | at top of nitrogen stripper column 42 | 130 | 79.73 | 1.32 | 99.35 | 0.62 | 270 ppm |
| 10 | prior to compression | 500 | 298 | 1 | 78.113 | 0.931 | 20.956 |
| 10 | after compression | 500 | 293 | 7.9 | 78.113 | 0.931 | 20.956 |
| 78 | after expansion | 50 | 123.9 | 1.43 | 78.113 | 0.931 | 20.956 |
| 74 | after passage through heat exchanger 38 | 261.5 | 101.4 | 1.2 | 99.97 | 0.03 | 1.3 ppm |
| 74 | after passage through main heat exchanger 16 | 261.5 | 289.6 | 1.1 | 99.97 | 0.03 | 1.3 ppm |
| 76 | after passage through heat exchanger 38 | 130 | 101.4 | 1.2 | 99.35 | 0.62 | 270 ppm |
| 76 | after passage through main heat exchanger 16 | 130 | 289.6 | 1.1 | 99.35 | 0.62 | 270 ppm |
| 72 | after passage from main heat exchanger 16 | 105.5 | 289.6 | 1.976 | 0 | 0.5 | 99.5 |

In EXAMPLE 2 given above, nitrogen stripper column 42 has approximately 65 theoretical stages. Stream 76 is withdrawn at theoretical stage 6 and passed first through heat exchanger 39 and next through main heat exchanger 16. Stream 76 can then be exhausted as waste or used to regenerate purifier 12. Stream 74 is withdrawn at theoretical stage 1 and passed first through heat exchanger 39 and next through main heat exchanger 16. Stream 74 can then be exhausted as waste or taken as product or any division of the two. Stream 34 (after subcooling) is split into streams 36 and 38. Stream 38 is flashed into nitrogen stripper column 42 at theoretical stage 20. Stream 36 is expanded through valve 64 and vaporized in argon column condenser 59. Stream 36 after vaporization is fed into nitrogen stripper column 42 at theoretical stage 30. Argon column 50 has approximately 220 stages of which 185 are rectifying and 35 are stripping. Stream 48 is taken from the bottom of nitrogen stripper 42 and fed to theoretical stage 185 of argon column 50. Stream 56 is withdrawn to the bottom of nitrogen stripper 42. The argon product as indicated is produced at a rate of 3.3 kg-moles/hr and has a concentration of 0.3 ppm nitrogen and 9.3 ppm oxygen with balance argon.

While the invention has been described with reference to a preferred embodiment, as will occur to those skilled in the art, numerous additions, changes and omissions can be made without departing from the spirit and scope of the present invention.

We claim:

1. A cryogenic air separation process for producing high purity argon comprising:

compressing and purifying the air;

cooling the air after compression and purification thereof to a temperature suitable for its rectification;

rectifying the air in a rectification column so that an oxygen enriched liquid column bottom and a nitrogen rich tower overhead are produced within the rectification column;

separating an argon-oxygen containing liquid lean in nitrogen within an argon column to form a liquid oxygen column bottom and a high purity argon vapor tower overhead;

removing an argon stream composed of the high purity argon vapor tower overhead from the argon column, condensing the argon stream by indirect heat exchange, and introducing the argon stream, after having been condensed, back into the argon column as reflux;

removing an oxygen enriched stream composed of the oxygen enriched liquid column bottom from the rectification column, expanding the oxygen enriched stream to a pressure at which the oxygen rich liquid has a temperature no greater than the condensation temperature of the high purity argon vapor tower overhead, at least partially vaporizing the oxygen enriched stream against the condensation of the argon stream through the indirect heat exchange, and then introducing the oxygen enriched stream, after having been at least partially vaporized, into the nitrogen stripper column at an entry level thereof having a concentration compatible with that of the oxygen enriched stream;

stripping nitrogen from the oxygen enriched stream introduced into the nitrogen stripper column with a stripper gas so that the argon-oxygen containing liquid lean in nitrogen is produced as an argon-oxygen liquid column bottom;

removing an argon-oxygen stream composed of the argon-oxygen liquid column bottom from the nitrogen stripper column and introducing it into the argon column for the separation of the argon-oxygen containing liquid and for vaporization of part of the argon-oxygen containing liquid, thereby to produce the stripper gas;

removing the stripper gas from the argon column and introducing it into the nitrogen stripper column;

regulating the nitrogen stripper column to operate at a predetermined pressure range by regulating stripper gas pressure of the stripper gas upon its entry into the nitrogen stripper column so that the entry level of the oxygen enriched stream has a pressure level no greater than the pressure of the oxygen enriched stream after expansion to allow the oxygen enriched stream to flow into the nitrogen stripper column and the argon column operates at a higher pressure range than the predetermined pressure range of the nitrogen stripper column so that the stripper gas flows into the nitrogen stripper column under impetus of a pressure differential therebetween;

the argon-oxygen stream being made to flow into the argon column by increasing its head; and removing a product stream from the argon column composed of the argon vapor tower overhead.

2. The process of claim 1, wherein the nitrogen rich tower overhead of the rectification column is condensed against vaporizing the liquid oxygen column bottom contained within the argon column to form liquid nitrogen, the liquid nitrogen is in part returned to the rectification column as liquid nitrogen reflux and is also formed into a reflux stream which is introduced into the nitrogen stripper column as reflux.

3. The process of claim 1, wherein:

product and waste nitrogen streams are removed from the nitrogen stripper column;

a product oxygen stream is removed from the argon column;

a reflux stream composed of the nitrogen rich tower overhead is removed from the rectification column and is introduced into the nitrogen stripper column as a nitrogen containing reflux; the reflux stream and the oxygen enriched stream are subcooled through indirect heat exchange with the product and waste nitrogen streams which as a result partially warm; and the product oxygen and product and waste nitrogen streams are fully warmed subsequent to their said indirect heat exchange with the reflux stream and the oxygen enriched stream.

4. The process of claim 1, wherein the air is cooled as an air stream and the process is kept in heat balance by diverting a subsidiary air stream from the air stream, after the air has been partially cooled, expanding said subsidiary air stream with the performance of work and introducing all or part of the subsidiary air stream into the nitrogen stripper column.

5. A cryogenic air separation apparatus comprising:

compression means for compressing the air;

purification means connected to the compression means for purifying the air;

cooling means connected to the purification means for cooling the air to a temperature suitable for its rectification; and a distillation column system having, a rectification column connected to the cooling means and configured to rectify the air so that an oxygen enriched liquid column bottom and a nitrogen rich vapor tower overhead are produced therewithin;

an argon column configured to separate an argon-oxygen containing liquid lean in nitrogen into a liquid oxygen column bottom and a high purity argon vapor tower overhead;

an expansion valve connected to the rectification column and configured to expand an oxygen enriched stream composed of the oxygen rich liquid column bottom to a pressure at which the oxygen enriched stream has a reduced temperature no greater than the condensation temperature of the high purity argon vapor tower overhead;

a head condenser connected to the argon column and the expansion valve, the head condenser configured to condense an argon stream composed of the high purity argon vapor tower overhead through indirect heat exchange with the oxygen enriched stream, thereby at least partially vaporize the oxygen enriched stream and to return the argon stream after having been condensed to the argon column as reflux;

a nitrogen stripper column configured to strip nitrogen from the oxygen enriched stream with a stripper gas so that the argon-oxygen containing liquid lean in nitrogen as a column bottom is formed therewithin;

the nitrogen stripper column connected to the head condenser so that the oxygen enriched stream after having been at least partially vaporized flows into the nitrogen stripper column at an entry level thereof having a concentration compatible with the oxygen enriched stream;

means for connecting the nitrogen stripper column to the argon column so that an argon-oxygen stream composed of the argon-oxygen containing liquid flows into the argon column and in part vaporizes to produce the stripper gas;

the argon column connected to nitrogen stripper column so that the stripper gas flows from the argon column to the nitrogen stripper column;

a pressure reduction valve intermediate the argon and nitrogen stripper columns for reducing the pressure of the stripper gas upon its entry to the nitrogen stripper column, thereby to regulate operating pressure range of the nitrogen stripper column so that the entry level of the oxygen enriched stream is at a pressure level no greater than the pressure of the oxygen enriched stream after having been expanded to allow the oxygen enriched stream to flow into the nitrogen stripper column and the argon column operates at a higher pressure range than the pressure range of the nitrogen stripper column so that the stripper gas flows into the nitrogen stripper column under impetus of a pressure differential therebetween; and means connected to the argon column for forming a product stream composed of the high purity argon tower overhead vapor.

6. The apparatus of claim 5, wherein:

the nitrogen stripper column and argon column connection means comprises a conduit for introducing the argon-oxygen stream from the nitrogen stripper column into the argon column and a mounting for the nitrogen stripper column elevated sufficiently with respect to the argon column such that the argon-oxygen stream has a sufficient head to flow into the argon column.

7. The apparatus of claims 5 or 6, wherein:

the rectification and argon columns are connected in a heat transfer relationship by a condenser reboiler for condensing the nitrogen rich tower overhead of the rectification column against vaporizing the liquid oxygen column bottom contained within the argon column to form liquid nitrogen; and the apparatus further comprises a conduit connecting the condenser reboiler to the nitrogen stripper column so that a liquid nitrogen stream is introduced into the nitrogen stripper column as reflux.

8. The apparatus of claim 7, wherein:

the apparatus further comprises subcooling means connected to the nitrogen stripper column and to the rectification column for warming product and waste nitrogen streams removed from the nitrogen stripper column against subcooling the liquid nitrogen stream and the oxygen enriched stream; and the cooling means comprises a main heat exchanger having a first pass communicating between the purification means and the rectification column and through which the air cools prior to entering the rectification column, a second pass in communication with the argon column so that a product oxygen stream composed of the high purity oxygen fully warms against the cooling of the air, and third and fourth passes in communication with the subcooling means so that after the product and waste nitrogen streams warm, the product and waste nitrogen streams fully warm in the main heat exchanger against the cooling of the air.

9. The apparatus of claims 8, further comprising a turbo expander communicating between the nitrogen stripper column and the first pass of the main heat exchanger so that a partially cooled air stream is expanded in the turboexpander and then is introduced into the nitrogen stripper column to maintain the apparatus in heat balance.

* * * * *